US006349427B1

(12) United States Patent
Bergstrom

(10) Patent No.: US 6,349,427 B1
(45) Date of Patent: Feb. 26, 2002

(54) PORTABLE SPA CONSTRUCTION

(75) Inventor: Neil R. Bergstrom, La Mesa, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

(21) Appl. No.: 09/562,608

(22) Filed: May 1, 2000

(51) Int. Cl.[7] ..... A47K 3/00
(52) U.S. Cl. ..... 4/541.1; 4/592; 4/593
(58) Field of Search ..... 4/541.1, 592, 593, 4/584, 506; 220/647, 668, 23.91, 23.87, 608, 673, 675; 52/169.7, 649.3, 35, 70, 169.8

(56) References Cited

U.S. PATENT DOCUMENTS 1,164,502 A * 12/1915 Griffith
1,917,764 A * 7/1933 Howie
3,254,490 A * 6/1966 Moore
3,938,199 A * 2/1976 Laven
4,289,717 A * 9/1981 Bortz ..... 4/584
5,186,351 A * 2/1993 Gallo et al. ..... 220/668
5,351,847 A * 10/1994 Greenbaum ..... 220/608
5,531,352 A * 7/1996 Kraft et al. ..... 220/675
5,791,098 A * 8/1998 Thomas
5,974,600 A * 11/1999 Pucci et al. ..... 4/498

* cited by examiner

*Primary Examiner*—Timothy L. Maust
*Assistant Examiner*—Khoa Huynh
(74) *Attorney, Agent, or Firm*—Price and Gess

(57) ABSTRACT

A spa construction wherein a spa shell is supported and reinforced by a matrix of interlocking horizontal and vertical members attached to a base grid. The matrix supports the spa shell through contact with only two regions of the spa—namely the bar top and footwell areas. The construction eliminates the necessity to encase the shell in structural foam and facilitates ready access to spa plumbing.

9 Claims, 5 Drawing Sheets

PORTABLE SPA CONSTRUCTION

BACKGROUND OF THE INVENTION

1. Field of the Invention

The subject invention relates generally to the field of spas, whirlpools and the like, and more particularly to a portable spa construction employing a matrix of interlocking horizontal and vertical members which supports a spa shell and receives and distributes loads applied by the spa shell.

2. Description of Related Art

In the past, portable spa construction has typically employed a plastic shell which contains the spa water. The shell has typically been supported against the weight of the water by a relatively thick layer of rigid structural foam surrounding the entire shell. The structural foam provides structural support and strength to the relatively thin plastic shell. The shell and foam structure has typically been located within a simple box-like structure of wood beams, which provides no support to the shell itself. The box-like wood beam structure serves to support skirting which conceals the shell and the spa equipment and provides a finished appearance.

SUMMARY OF THE INVENTION

According to the invention, a portable spa construction is provided wherein an interlocking rib structure surrounds a spa shell and absorbs the primary loads of the shell. No structural foam layer is then necessary, resulting in a relatively lighter, stronger structure, which yields a number of advantages in fabrication and maintenance.

Various objects, features and advantages of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims. The present invention will become apparent when taken in conjunction with the following description and attached drawings, wherein like characters indicate like parts, and which drawings form a part of this application.

BRIEF DESCRIPTION OF THE DRAWINGS

A preferred embodiment of the just summarized invention will now be described in detail in conjunction with the drawings of which.

DETAILED DESCRIPTION OF A PREFERRED EMBODIMENT

Figure 1:
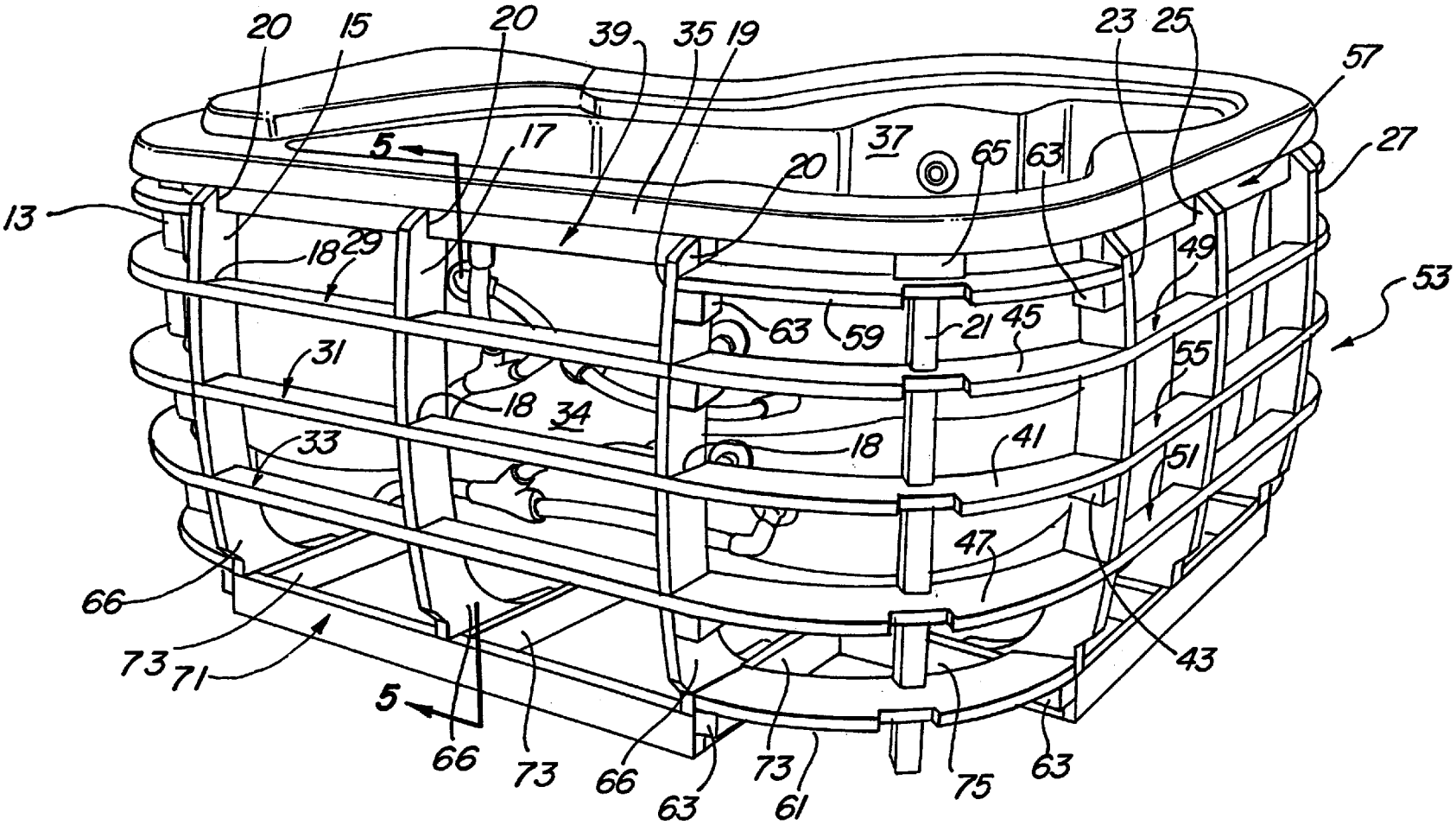
FIG. 1 is a rear perspective view of a spa construction according to the preferred embodiment of the invention.

A spa construction according to a preferred embodiment is illustrated in FIGS. 1–4. With reference to FIG. 1, it will be seen that the construction comprises a matrix of interlocking horizontal and vertical members. These include a plurality of vertical members or struts 13, 15, 17, 19, 21, 23, 25, 27, and a first set of horizontal members or ribs 29, 31, 33. These ribs 29, 31, 33 lie parallel to one another and are fixedly glued or mechanically fastened in slots, e.g., 18 in three of the vertical members 15, 17, 19. These vertical members 15, 17, 19 may be viewed as cooperating in defining a first side 34 of the frame structure.

It will be observed that the middle horizontal member 31 passes through the slot 18 in the vertical member 19 and transitions into a first arcuate end portion 41, which then interlocks with the fourth and fifth vertical member 19, 21, and finally attaches to the sixth vertical member 23 via an attachment block 43. Second and third arcuate end portions 45, 47 of the same shape as portion 41 are located equidistantly above and below that end portion 41. These second and third arcuate end portions 45, 47 are integral parts of fourth and fifth parallel horizontal members 49, 51, which form part of a second side 53 of the frame structure. The second side 53 is further defined by vertical members 25, 27 which interlock with the fourth and fifth horizontal members 49, 51 and a sixth horizontal member 55. A seventh horizontal member 57 transfers force from a second side of the spa shell bar top 35 to the vertical members 23, 25, 27.

The first corner of the frame structure between the first and second sides 34, 53 is defined by the vertical member 21, the arcuate end portions 41, 45, 47 and first and second arcuate horizontal segments 59, 61. The segments 59, 61 are fixedly attached (glued/nailed, etc.) via blocks to 63 to the vertical members 19, 23. As may be seen in FIG. 4, a support block 65 located between the bar top 35 and the segment 59 transfers force from the corner of the bar top 35 into the frame structure. It will be observed from the foregoing description that the preferred construction offsets the butt joints of the various horizontal members so as to avoid any obvious seams in the construction which could weaken it.

Figure 3:
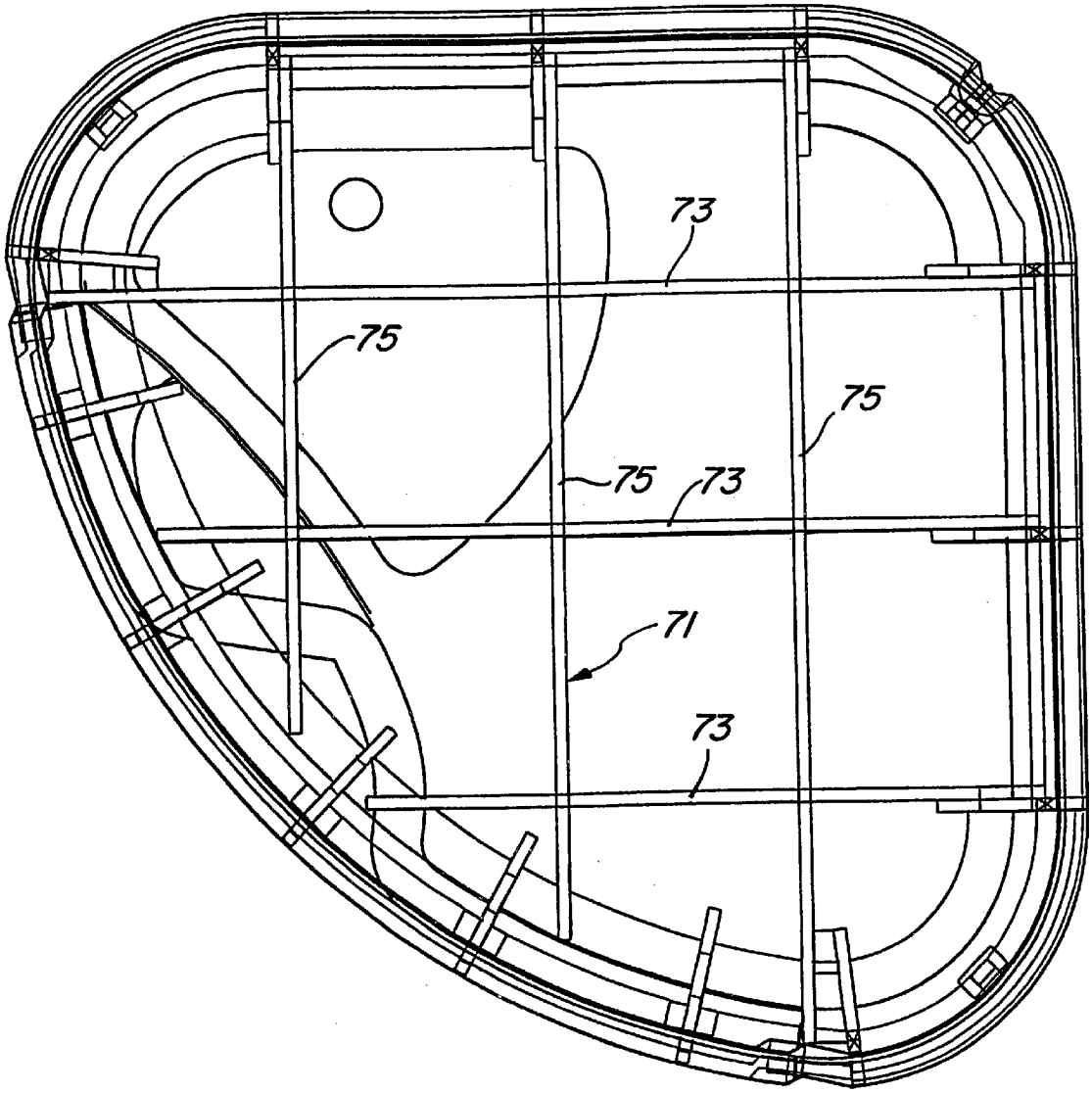
FIG. 3 is a top plan view illustrating aspects of the spa construction of FIGS. 1 and 2.

The bottom ends, e.g., 66 of the vertical members, e.g., 13, 15, 17, 19, 21, 23, 25, 27 are attached to respective grid members of a floor grid structure 71 by gluing or mechanically fastening. As illustrated in FIG. 3, this floor grid 71 includes a number of interlocking horizontal and vertical members 73, 75. The footwell or bottom 77 (FIG. 4 and FIG. 5) of the spa shell 37 is supported by the floor grid 71.

Figure 2:
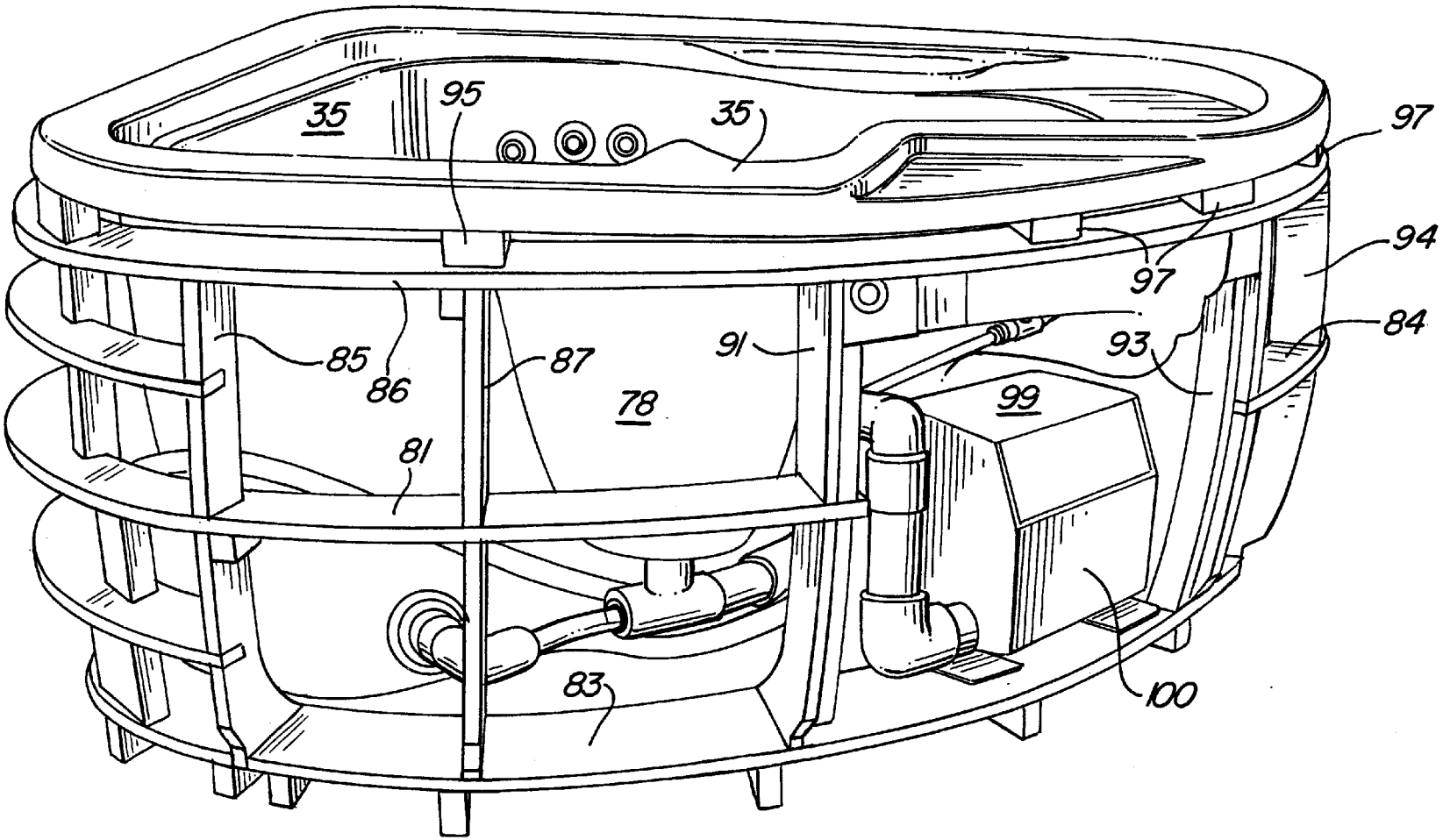
FIG. 2 is a front perspective view of the spa construction of FIG. 1.

The third side 78 of the frame/spa structure is illustrated in FIG. 2. The interlocking frame structure is continued on this third side 78 using interlocking horizontal members 81, 83, 84 and vertical members, e.g., 85, 87, 91, 93, 94. Suitable support blocks 95, 97, transfer force from the bar top into the frame structure via a horizontal member 86. The structural members are more widely spaced in FIG. 2 to provide a rectangular opening 99, and other spaces providing access to portions of the spa equipment, e.g., 100.

Figure 5:
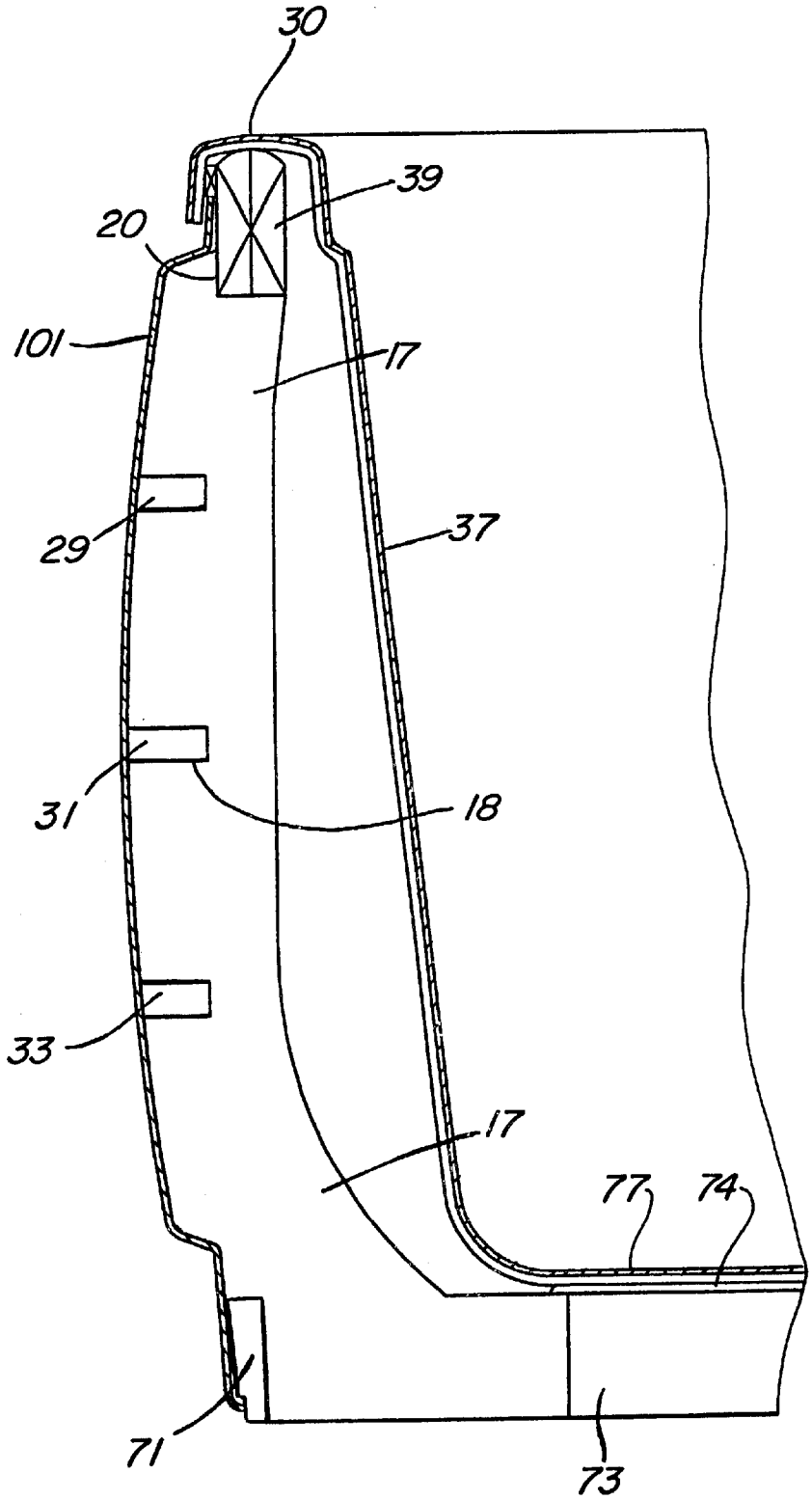
FIG. 5 is a fragmented sectional view taken at 5—5 of FIG. 1 with details of the spa equipment omitted.

With reference to FIG. 5, it will be observed that there is a small gap or space 74 between the top of the grid 73 and the outer surface of the footwell 77. In the preferred embodiment, this gap or space is shot with foam having a compressive or resilient characteristic. The resilient characteristic of the foam facilitates load distribution when the spa is filled with water such that both the bar top and footwell apply loads into the frame and grid structure. Foam may also be squirted in about the bar top area to lock the spa shell to the upper end of the frame, e.g., member 39.

Figure 4:
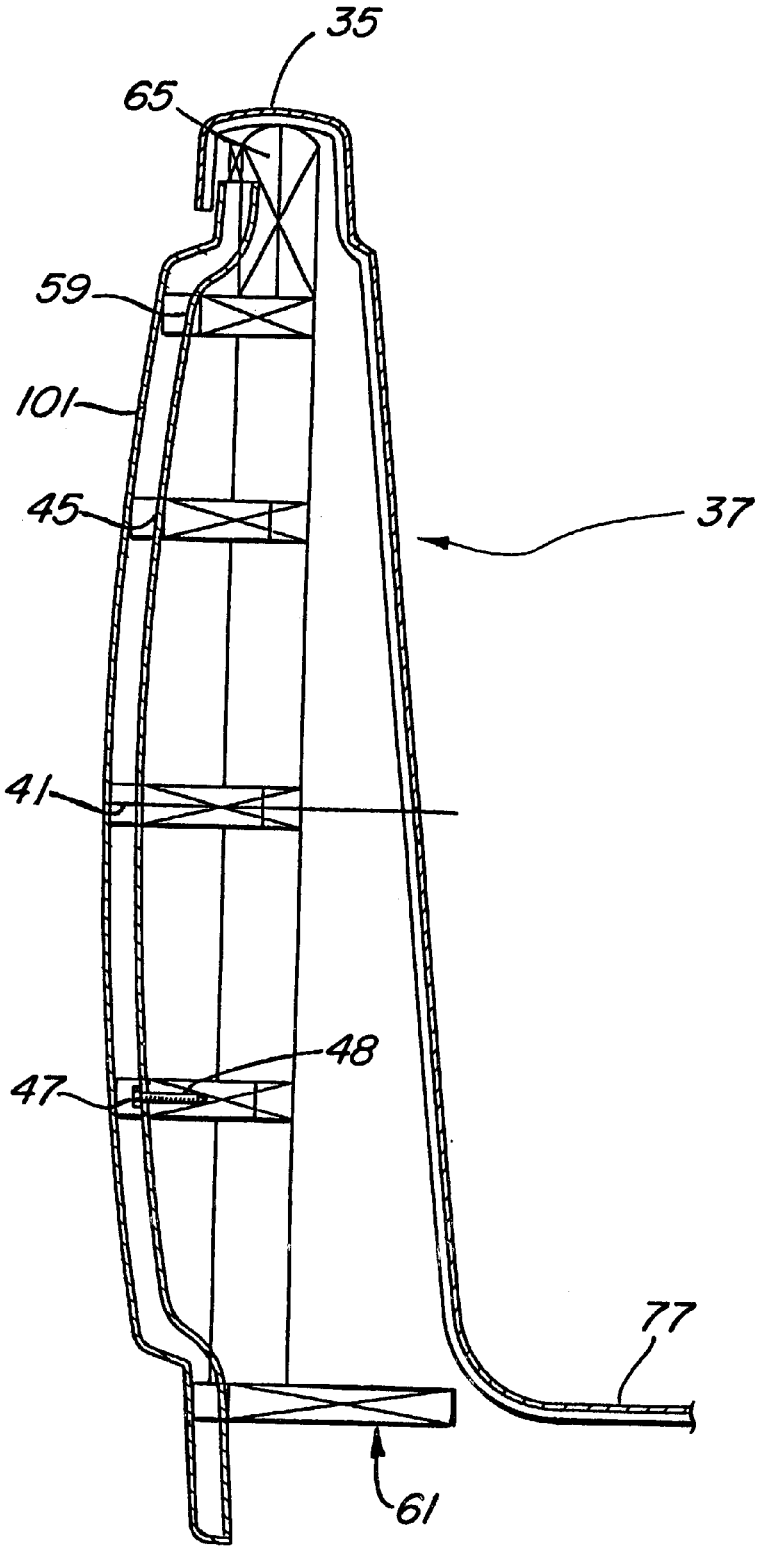
FIG. 4 is a fragmented side sectional view taken at a rear corner of the spa construction of FIGS. 1 and 2.

To finish the spa, an outer shell or skin 101 is bolted to the structure framing members via bolts, e.g., 48, as illustrated in FIG. 4. This construction further links the frame structure together and adds additional structural strength and reinforcement.

The spa construction of the preferred embodiment offers a number of advantages over conventional methods. First, a much higher strength-to-weight ratio is achieved, resulting in a lighter structure. The primary loads are further transferred into the framing structure, eliminating the need for the shell structure to withstand those loads. As a result, no structural foam needs to be applied to support the spa shell. The absence of structural foam permits plumbing components normally encased in foam to be readily accessed for troubleshooting during manufacture or for repair after sale. Additionally, the frame members can be CNC cut such that the various pieces can be nested together in a sheet of material to provide very efficient use of material. Additionally, the structural pieces can be fabricated so they can only be assembled in one way, thereby eliminating guesswork and mistakes and further speeding manufacture.

The preferred construction approach has been illustrated in the context of a three-sided spa. Those skilled in the art will appreciate that it may be applied to various other spa shapes such as square, rectangular, or circular. The structural framing illustrated in FIGS. 1–4 may be made of wood, plastic or metal, e.g., aluminum. Those skilled in the art will thus appreciate that various adaptations and modifications of the just described preferred embodiments can be configured without departing from the scope and spirit of the invention. Therefore, it is to be understood that within the scope of the appended claims, the invention may be practiced other than as specifically described herein.

What is claimed is:

1. A support structure in combination with a spa comprising:

a spa shell having a periphery;

a plurality of horizontal frame members, each horizontal frame member having a thickness that is relatively small compared to its length and width; and a plurality of vertical frame members, each vertical frame member having a thickness that is relatively small compared to its length and width, some of the vertical frame members having spaced apart slots cut across their width along their length, the slots matching the thickness of a horizontal member for receiving the horizontal member;

whereby the plurality of horizontal frame members and vertical frame members form a matrix of interlocking horizontal and vertical frame members enclosed the periphery of the spa shell.

2. The support structure of claim 1 wherein the spa shell is three sided.

3. The support structure of claim 1 further comprising a slot cut into the top of each of the vertical frame members, along its length, matching the thickness of a horizontal frame member, for receiving a horizontal frame member on edge, along its width.

4. The support structure of claim 3 wherein the horizontal frame member disposed in the slots in the top of the vertical members adjacent the rim of the spa shell supports the vertical force from the rim in combination with the plurality of vertical frame members.

5. The support structure of claim 4 further comprising a plurality of butt joints between a plurality of horizontal frame members, the butt joints being offset from one another so as to avoid seams in the support structure.

6. The support structure of claim 3 further comprising a grid to which each vertical frame member is attached and upon which the bottom of the spa shell rests.

7. The support structure of claim 6 wherein the grid comprises a matrix of interlocking members disposed at right angles to one another.

8. The support structure of claim 6 further comprising an outer skin attached to the vertical and horizontal frame members, the skin serving to further strengthen the construction.

9. The support structure of claim 6 wherein the load of the spa shell is carried by a horizontal member disposed in the slots in the top of the vertical members, at the rim of the spa shell and by the grid.

* * * * *